United States Patent [19]

Ominato et al.

[11] Patent Number: 4,761,091

[45] Date of Patent: Aug. 2, 1988

[54] BINDING DEVICE

[75] Inventors: Kiyoshi Ominato; Satoshi Mizutani, both of Tokyo, Japan

[73] Assignee: King Jim Co., Ltd., Tokyo, Japan

[21] Appl. No.: 42,654

[22] Filed: Apr. 28, 1987

[30] Foreign Application Priority Data

Apr. 28, 1986 [JP] Japan ..... 61-63158[U]

[51] Int. Cl.[4] ..... B42F 13/00; B42F 13/12; B42F 13/36; B42F 3/00

[52] U.S. Cl. ..... 402/76; 402/22; 402/60; 402/61

[58] Field of Search ..... 402/19, 20, 21, 22, 402/31, 34, 52, 54, 60, 68, 72, 76, 80 R, 77, 78; 411/340, 341, 342, 343, 344, 345, 346, 508, 509, 510

[56] References Cited

U.S. PATENT DOCUMENTS

| | | | |
|---|---|---|---|
| 1,647,635 | 11/1927 | Kahn | 402/61 |
| 1,849,243 | 3/1932 | Moore | 402/61 |
| 2,915,068 | 12/1959 | Miyamoto | 402/60 |
| 3,008,470 | 11/1961 | Rubinstein | 402/60 |
| 3,574,472 | 4/1971 | Cott | 402/22 |
| 3,612,709 | 10/1971 | Miyamoto | 402/22 |

*Primary Examiner*—E. R. Kazenske
*Assistant Examiner*—Paul M. Heyrana, Sr.
*Attorney, Agent, or Firm*—Young & Thompson

[57] ABSTRACT

A binding device is disclosed, which comprises a fixture having at least two binding rods, a cover plate having means for engaging with ends of the binding rods and an elastically displaceable connection providing a plurality of divided elastic piece members for interconnecting the fixture with the cover plate at their longitudinal ends, wherein the fixture, the cover plate and the elastic connection are integrally and displaceably formed.

2 Claims, 5 Drawing Sheets

BINDING DEVICE

FIELD OF THE INVENTION

This invention relates to a binding device for use as a means for conveniently filing papers and the like by being secured to a filing cover, particularly to a binding device suitable for filing a great volume of papers and the like.

BACKGROUND OF THE INVENTION

Hitherto, there have been proposed and utilized many types of binding devices for filing papers and the like, which as a binding volume increases generally become unstable for binding operation, resulting in removal of bound papers. To file a great volume of papers or the like, therefore, special contrivances have been required for such binding devices.

A binding device of the aforementioned type has been disclosed in the Japapese Laid-open Patent Publication No. 48-58915. Namely, according to one embodiment of this conventional binder particularly as shown in FIG. 11, the binding device comprise a fixture 10 and a cover plate 12 both made of synthetic resins, said cover plate 12 being provided with a slide opening 14 for slidably supporting a slide piece member 18 with engagement recesses 16, 16 so that the slide piece member 18 upon movement engages and disengages with a recess of a binding rod 20 for fixing and releasing the cover plate 12 from the fixture 10.

Furthermore, according to another example as shown in FIG. 12, a slide plate 22 is integrally formed with a cover plate 24 and at the boundary portion between the slide plate 22 and the cover plate 24 is formed a hinge slit 26 for conveniently releasing the cover plate 24. The slide plate 22 is further provided with a slide slit 28 providing therein a fixing plate 30 which includes binding rods 34, 34 having engagement recesses 32, 32, while the cover plate 24 is provided at its external end with engagement piece members 36, 36 for engagement with the recess 32 of the binding rod 34 and the slide plate 22 and the cover plate 24 are moved together toward the fixing plate 30 to engage the binding rods 34, 34 with the cover plate 24. The fixture is further connected with the cover plate by means of a spring and under the spring function the cover plate may be enagaged with or removed from the binding rods.

In other words, according to such a conventional binding device the binding rods 20, 20 or 34, 34 for binding papers are firmly supported and engaged within a solid frame body comprising a fixture 10, a cover plate 12 and a slide piece 18 or a slide plate 22, a fixing plate 30, a cover plate 24 and engagement pieces 36, so that the filed papers, even if in plenty, may neither be unstable nor released.

The binding devices as hereinbefore described, however, usually consist of a plural member of components in combination, resulting in their complicated manufacturing process with a high cost and are further troublesome in filing operations.

Therefore, an object of the invention is to provide a binding device which may be integrally molded and may provide a convenient binding operation.

SUMMARY OF THE INVENTION

In order to accomplish the foregoing object, the binding device according to the invention comprises a fixture having at least two binding rods, a cover plate having means for engaging with ends of the binding rods and an elastic and displaceable connection of a plurality of elastic divisions for releaseably and displaceably interconnecting the fixture with the cover plate along their longitudinal end, wherein said fixture, cover plate and elastic connection are formed integrally and displaceably.

The elastic connection may be provided with a top plate and a bottom plate and connections between these plates and the fixture and the cover plate may preferably be formed into thin hinges. The elastic connection may preferably be provided with a stopper means for restricting an elastic displacement latitude of the connection, and the stopper means may be formed at the opposite ends or in the center part of the elastic connection. Furthermore, the elastic connection may preferably be provided with either hinge-like elastic divisions and elastic support plates or thin board-like elastic divisions or hinge-like elastic divisions piece members and elastic members formed in the connection.

Relative and displaceable interconnection between the fixture and the cover plate may perform engagement and release of the binding rods provided in the fixture with and from the engagement means provided in the cover plate without any slide member, resulting in a simple structure of the binding device for an integral molding. In the filing operation, an opening and closing of the cover plate or an engagement and release of the binding rods from the engagement means may conveniently be carried out by a mere displacement of the cover plate toward the fixture, resulting in a convenient filing operation.

For better understanding, the invention will now be described hereinafter in more detail with reference to the accompanying drawings.

PREFERRED EMBODIMENTS OF THE INVENTION

Figure 1:
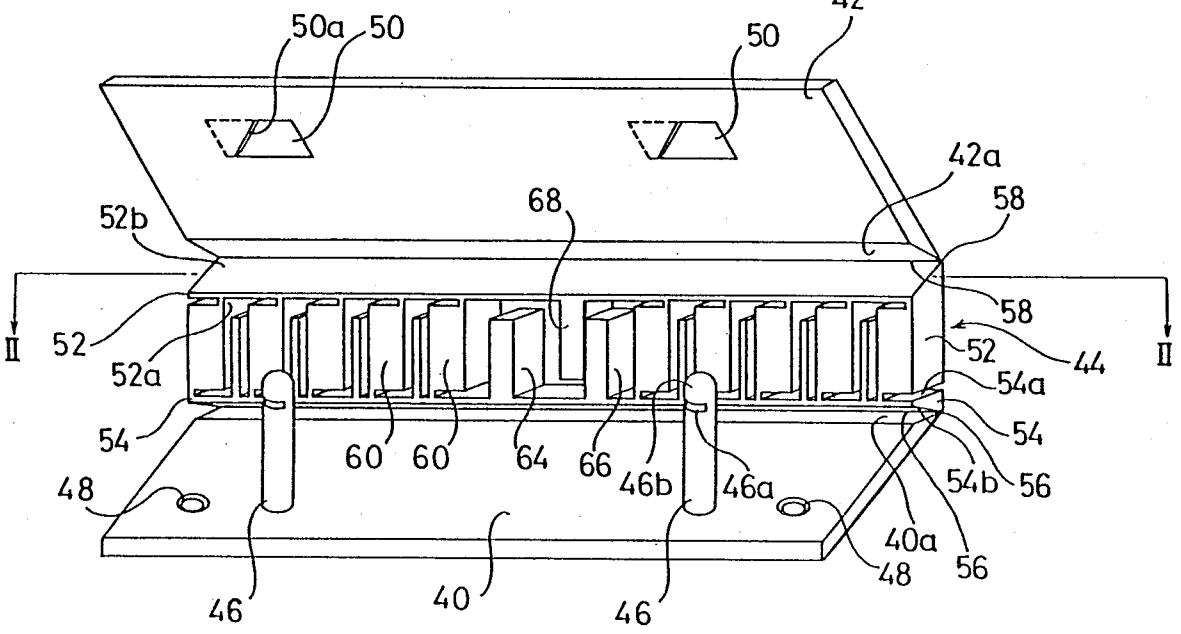
FIG. 1 is a perspective view of one embodiment of the binding device according to the invention.
Figure 2:
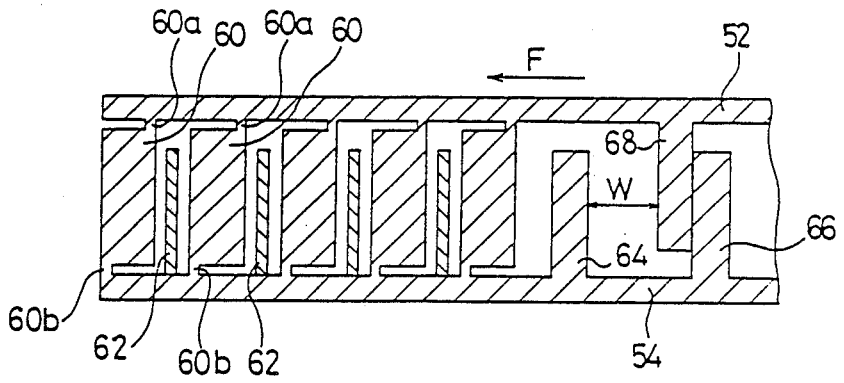
FIG. 2 is an enlarged sectional view of the elastic connection taken along the line II—II of FIG. 1.

In FIGS. 1 and 2, the binding device according to the invention foundamentally comprises a fixture 40, a cover plate 42 and an elastic connection 44 for interconnection thereof and these members are formed integrally.

The structures of the fixture, the cover plate and the elastic connection of foundamental members will now be described more in detail. The fixture 40 is provided at its somewhat front part with two binding rods 46, 46 for piercing papers and also with two aperatures 48 in the vicinity of the binding rods 46, 46 for securing the fixture 40 to the inside of the filing cover. A recess **46*a* is provided in the vicinity of the top of the binding rod 46 which is formed into a spherical guide surface 46*b*. The number and position of the binding rods may conveniently be determined according to the purpose. The cover plate 42 is provided at the corresponding position to the binding rod 46 of the fixture 40 with an engaging means including an engagement opening 50 with an engaging ear 50*a* for engagement with the recess 46*a* when the cover plate 42 is closed. An external structure of the elastic connection 44 comprises a top plate 52 and a bottom plate 54 with corresponding internal surfaces 52*a* and 54*a* located in parallel position with each other, while the external surfaces 52*b* and 54*b* are tapered at nearly 45° against the respective internal surfaces. Furthermore, the fixture 40 and the elastic connection 44 are interconnected through a hinge-like thin connection member 56 formed by one longitudinal end 40*a* provided at a taper surface of nearly 45° against the fixture 40 and a bottom plate 54 of the elastic connection 44, while the cover plate 42 and the elastic connection 44 are interconnected through a hinge-like thin connection member 58 formed by one longitudinal end 42*a* provided at a taper surface of nearly 45° against the cover plate 42 and the top plate 42 of the elastic connection 44. Thus, the cover plate 42 is releaseably coupled with the fixture 40 through the hinge-like thin connection members 56 and 58, so that the cover plate 42 when closed against the fixture 40 is fixed in a stable parallel position by means of the taper surfaces 40*a*, 54*b* and 42*a*, 52*b*. The component members 40, 42 and 44 are made of synthetic resin having an elasticity, so that the cover plate 42 is expandingly urged against the fixture 40 under elasticity of the hinge-like thin connection members 56 and 58. The fixture 40 may be formed integrally and normally to the bottom plate of the connection without any interconnection through a hinge-like thin connection member 56**.

Figure 3:
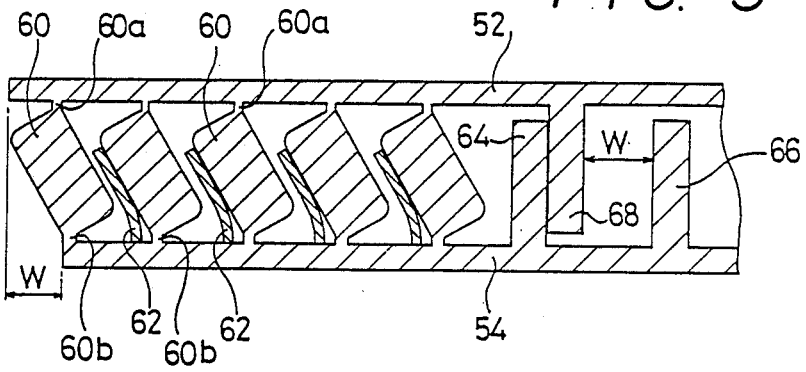
FIG. 3 is a sectional view of the elastic connection in the elastically displaced position of FIG. 2.

With reference to FIGS. 2 and 3, an elastic displacement mechanism inside the elastic connection 44 will now be described.

The elastic connection 44 comprises hinge-like elastic piece members 60 divided in parallel between the top plate 52 and the bottom plate 54 at the longitudinal opposite ends thereof, parallel elastic support plates 62 aligned in parallel and planted at their ends on the bottom plate 54 between the arm piece members 60, a pair of projection rods 64, 66 planted on the bottom plate 54 in the center of the support at a predetermined distance and a stopper means of a single engagement rod 68 planted on the top plate 52 in a position between the projection rods 64, 66. The divided hinge-like elastic piece members 60 at their upper portions are integrally joined with the top plate 52 through a hinge-like thin connection **60*a* partially recessed for the right as shown in the drawing and at their lower portions with the bottom plate 54 through a hinge-like thin connection 60*b* partially recessed for the left as illustrated in the drawing, so that the top plate 52 and the bottom plate 54 are displaceably coupled at their longitudinal end. Namely, FIG. 2 shows a normal condition where the top plate 52 and the bottom plate 54 are confronted each other. Under this normal position the elastic piece members 60 stand upright and the engagement rod 68 of the stopper means is engaged with the projection rod 66 controlling the upstanding position. In this position, when a power in the direction as shown by an arrow F is exerted to the top plate 52, the hinge-like elastic piece members 60 are elastically deformed as shown in FIG. 3, so that the top plate 52 is displaced in the left direction against the bottom plate 54 for the limited width W. At this position the elastic support plates 62 are inclined in the left direction by the elastic piece members 60 and the engagement rod 68 as a stopper is engaged with the projection rod 64 to control the displacement width W. When the power F is released from the displaced position, the top plate 52 is again restored to its normal position under elastic restorations of the elastic support plates 62 and the elastic piece members 60 as illustrated in FIG. 2. In the binding device according to the invention, a stopper means is not always required. For example, in the binder of the embodiment according to the invention restriction of the relative displacement of the elastic connection 44 in the right direction as illustrated in the figure is positively precluded by the piece members 60, so that the projection rod 66** controlling the upstanding position may be left out without any trouble.

Figure 4:
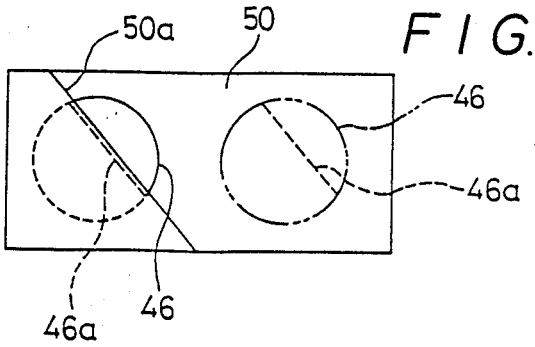
FIG. 4 is an enlarged plan view for illustration of the engaged as well as released positions between the binding rod and the engagement recess of FIG. 1.

The binder thus constructed according to the invention is fixed to the inside of the filing cover through the fastening holes 48 of the fixture 40 as shown in FIG. 1. The papers when filed are passed through the binding rods 46, 46 of the fixture 40 before the cover plate 42 is urged downwardly against the fixture 40. Then, the upper spherical guide surfaces **46*b* of the binding rods 46 are guided into the terminal portions of the engagement ears 50*a* of the engagement holes 50 provided in the cover plate 42, so that the cover plate 42 is slightly displaced against the fixture 40 through the elastic connection 44 and the heads of the binding rods 46 are inserted into the engagement holes 50. Then, the engagement ears 50 are inserted into the recesses 46*a* of the binding rods 46, so that the binding rods 46 are engagingly secured to the engagement holes 50 to restore the displacement of the cover plate 42 as shown in FIG. 4. Thus, the binding operation of papers may be conveniently carried out at one-touch operation. Further, release of the binder or removal of the binding rod 46 from the engagement holes 50 is carried out by pushing the cover plate 42 against the fixture 40 in the horizontal direction and the cover plate 42 is displaced against the fixture 40 through the elastic connection 44 so that the engagement ears 50*a* of the engagement holes 50 is disengaged from the recesses 46*a* of the binding rods 46 as illustrated in the drawing by a two-dotted line. Then, on release of the pressure against the cover plate 42 in the horizontal direction under such condition, the cover plate 42 is automatically released from the fixture 40 under the elasticity of the connecting portions 56 and 58. The removal of the cover plate 42, however, may readily be carried out by a slight outward turn thereof, even if the connection portions 56 and 58** have no elasticity.

Figure 5:
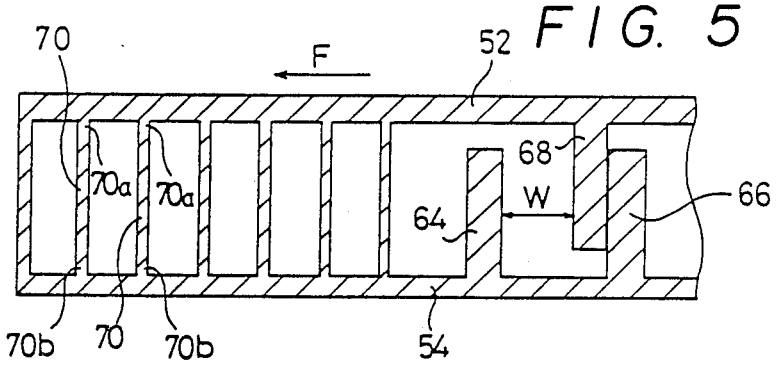
FIG. 5 is a sectional view corresponding to FIG. 2 of the elastic connection of another embodiment according to the invention.
Figure 6:
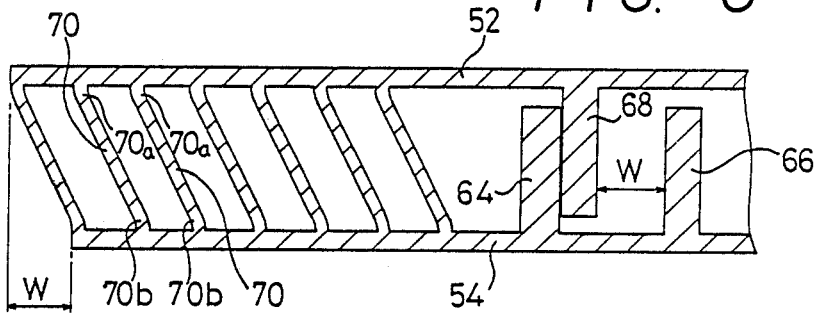
FIG. 6 is a sectional view of the elastic connection in the elastically displaced position of FIG. 5.

FIGS. 5 and 6 show an elastic connection of another embodiment according to the invention. In this embodiment, the elastic displacement mechanism of the hinge-like elastic separate piece members 60 and the elastic support plates 62 suspended therebetween as used in the first embodiment is replaced by a thin board-like separate elastic members. Namely, between the top plate 52 and the bottom plate 54 provided at the opposite ends of the connection are planted a plurailty of parallel thin board-like elastic separate piece members 70 which are integrally jointed with the plates 52 and 54 at their upper and lower end portions respectively. The connection is provided in its central part with a stopper means comprising a pair of projection rods 64, 66 on the bottom plate 54 and a single engagement rod 68 on the top plate 62. In such arrangement, when a left directed power F is exerted onto the top plate 52 under the normal condition as shown in FIG. 5, the thin board-like elastic separate piece members 70 are elastically displaced, so that the top plate 52 is displaced in the left direction against the bottom plate 54 for the limited width W as shown in FIG. 6. Then, when the power F is released in the displaced position, the top plate 52 is restored to its normal condition under elasticity of the elastic separate piece members 70 as shown in FIG. 5.

Figure 7:
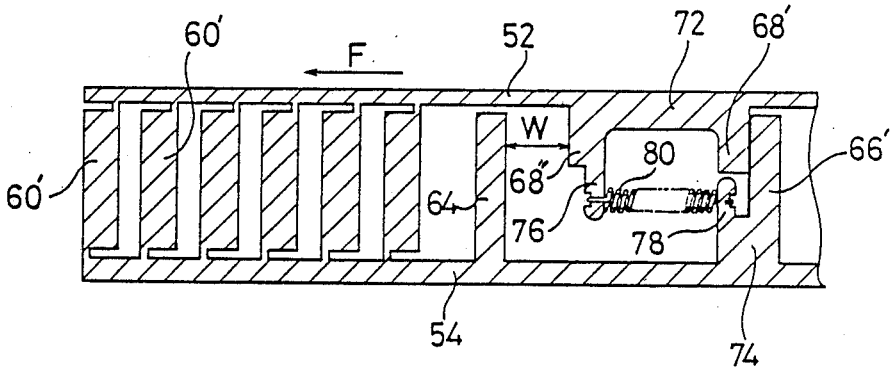
FIG. 7 is a sectional view corresponding to FIG. 2 or FIG. 5 of the elastic connection of a further embodiment according to the invention.
Figure 8:
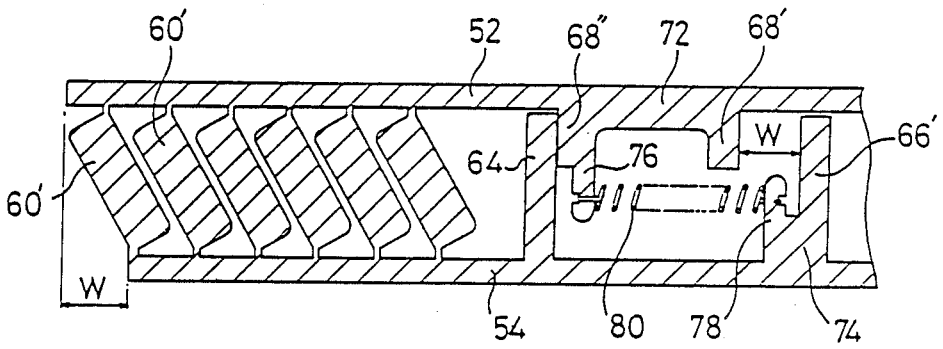
FIG. 8 is a sectional view of the elastic connection in the elastically displaced position of FIG. 7.

FIGS. 7 and 8 show an elastic connection of a further embodiment according to the invention where a displaceable restoration of the elastic connection is essentially provided by the elastic members interposed between the piece members. Namely, the support portions 72, 74 planted respectively on the top plate 52 and the bottom plate 54 in the central part of the connection is formed with a pair of support arms 76, 78 confronting at a predetermined distance over which a coil spring 80 is suspended to provide an essential displaceable restoration of the elastic connection. A support portion 74 is provided with a projection rod 66' providing a pair with a projection rod 64 planted on the bottom plate 54 and a support portion 72 is provided at its one end with engagement portions 68', 68" for engagement with the protrusion rods 64, 66'. Further, between the top plate 52 and the bottom plate 54 at the opposite ends of the connection the hinge-like elastic separate piece members 60' are aligned in parallel. In such arrangement, when the left directed power F is exerted onto the top plate 52 under a normal condition as shown in FIG. 7, a coil spring 80 is strecthed to elastically deform the elastic separate piece member 60', so that the top plate 52 is displaced in the left direction against the bottom plate 54 for the (limited) width W as shown in FIG. 8. At this moment, an engagement of the projection rod 64 with the engagement portion 68' restricts a displacement width W. Then, when the power F is released under the displaced condition, the top plate 52 is restored to its normal position under the tension of the stretched coil spring 80 as a principal restoration as shown in FIG. 7.

Figure 9:
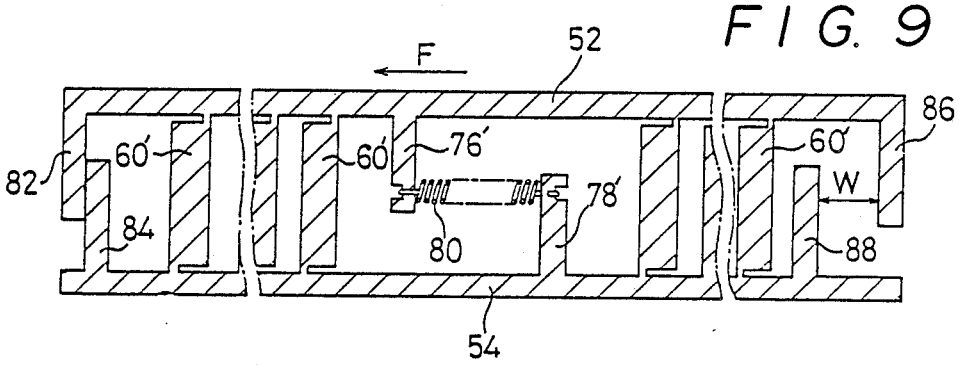
FIG. 9 is a sectional view corresponding to FIGS. 2, 5 or 7 of the elastic connection of a further embodiment according to the invention.
Figure 10:
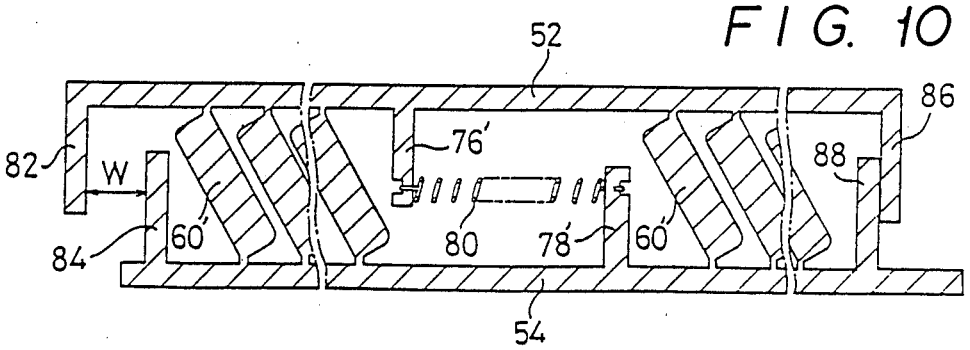
FIG. 10 is a sectional view of the elastic connection in the elastically displaced position of FIG. 9.
Figure 11:
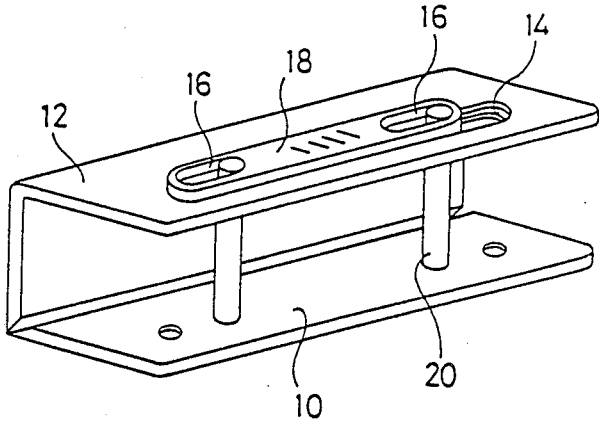
FIG. 11 is a perspective view of one embodiment of the conventional binding device.
Figure 12:
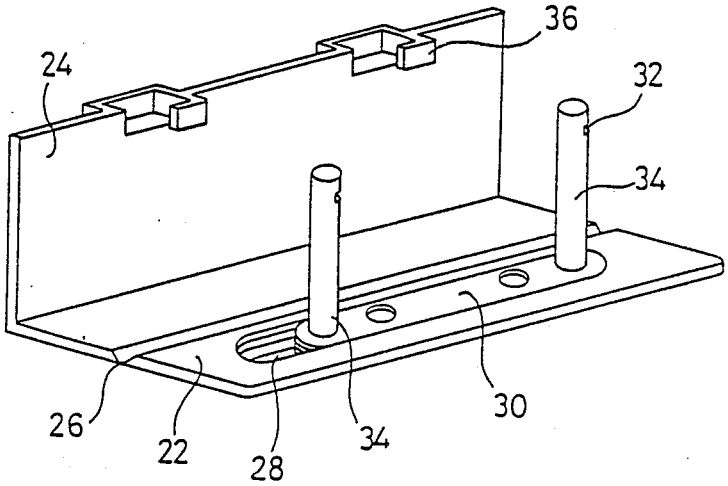
FIG. 12 is a perspective view of another embodiment of the conventional binding device.

FIGS. 9 and 10 show an elastic connection of a further embodiment according to the invention. In this embodiment, the stopper means located in the central part of the connection as illustrated in FIGS. 7 and 8 is provided at the opposite ends of the connection. Namely, the stopper means at the opposite ends of the connection comprises engagement rods 82, 86 provided at the opposite ends of the top plate 52 and projection rods 84, 88 provided in the vicinity of the opposite ends of the bottom plate 54.

Under the normal position of the connection as shown in FIG. 9, the left stopper means 82, 84 are engaged, while the right stopper means 86, 88 are separated at a predetermined displacement width W. Further, in the central part of the connection a coil spring 80 is suspended over the support arms 76' and 78' and at opposite ends of the coil spring hinge-like elastic separate piece members 60' are aligned in parallel.

In this arrangement, when a left directed power F is exerted onto the top plate 52 under a normal position as shown in FIG. 9, the coil spring 80 is stretched to elastically deform the elastic separate piece member 60', so that the top plate 52 is displaced in the left direction against the bottom plate 54 for the limited width W for engagement of the stopper means 86, 88 as shown in FIG. 10. Then, when the power F under the displaced condition is released, the top plate 52 is restored to its normal position as shown in FIG. 9 under the tension of the stretched coil spring 80 as a principal restoration.

As hereinbefore fully described, the binding device according to the invention is a simple in structure enabling an integral production as a whole unit with simplification of the manufacturing process and reduction of the manufacturing cost. Furthermore, the binding operations may conveniently be carried out by a mere relative displacement of the cover plate against the fixture.

Although the invention has been described with respect to the preferred embodiments thereof, it will be appreciated that many variations and modifcations may be made without departing from the true spirit and scope of the invention.

What is claimed is:

1. A binding device which comprises a fixture having at least two binding rods, a cover plate having means for engaging with ends of the binding rods and an elastically displaceable connection providing a plurality of divided elastic piece members for interconnecting the fixture with the cover plate at their longitudinal ends, wherein the fixture, the cover plate and the elastic connection are integrally and displaceably formed, the elastic connection providing a hinge-like thin joint portion recessed in the reverse direction at their upper and lower end portions, a plurality of parallel hinge-like elastic piece members integrally connected with the cover plate and the fixture respectively, and a plurality of parallel elastic support plates integrally associated with the cover plate or the fixture at their one end between the hinge-like elastic piece members.

2. A binding device which comprises a fixture having at least two binding rods, a cover plate having means for engaging with ends of the binding rods and an elastically displaceable connection providing a plurality of divided elastic piece members for interconnecting the fixture with the cover plate at their longitudinal ends, wherein the fixture, the cover plate and the elastic connection are integrally and displaceably formed, the elastic connection comprising parallel hinge-like divided elastic piece members suspended between the cover plate and the fixture at the longitudinal opposite ends, a pair of support arms planted symmetrically to the cover plate and the fixture at a predetermined distance in the center, and elastic members suspended over the support arms.

* * * * *